US006850128B2

(12) United States Patent
Park

(10) Patent No.: US 6,850,128 B2
(45) Date of Patent: Feb. 1, 2005

(54) ELECTROMAGNETIC COUPLING

(75) Inventor: Pyong K. Park, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 453 days.

(21) Appl. No.: 10/015,061

(22) Filed: Dec. 11, 2001

(65) Prior Publication Data

US 2003/0107451 A1 Jun. 12, 2003

(51) Int. Cl.[7] ..... H01P 5/03

(52) U.S. Cl. ..... 333/26; 333/248; 333/33; 333/24 C; 333/261; 333/256

(58) Field of Search ..... 333/26, 33, 248, 333/24 R, 24 C, 260, 261, 254, 256, 246

(56) References Cited

U.S. PATENT DOCUMENTS 4,556,265 A 12/1985 Cunningham
4,816,788 A * 3/1989 Ishikawa et al. ..... 333/203
5,307,030 A * 4/1994 King et al. ..... 333/24 R
5,334,941 A * 8/1994 King ..... 324/637
5,471,181 A 11/1995 Park
5,539,361 A 7/1996 Davidovitz
5,650,793 A 7/1997 Park
5,724,049 A 3/1998 Park et al.
5,726,664 A 3/1998 Park et al.
5,886,590 A 3/1999 Quan et al.
5,914,693 A 6/1999 Takei et al.
5,963,111 A 10/1999 Anderson et al.
6,236,287 B1 5/2001 Quan et al.
6,414,574 B1 * 7/2002 Knochel et al. ..... 333/246
6,515,561 B2 * 2/2003 Tamura et al. ..... 33/246

OTHER PUBLICATIONS

International Search Report, Application No. PCT/US02/36916, Filing Date: Nov. 18, 2002.

* cited by examiner

*Primary Examiner*—Robert Pascal
*Assistant Examiner*—Kimberly E Glenn
(74) *Attorney, Agent, or Firm*—Renner, Otto, Boisselle & Sklar, LLP

(57) ABSTRACT

An orthogonal electrical coupling relies on electromagnetic coupling for the inner connection, as opposed to direct contact between conductors. A conductor on one of the lines is connected to a ground plane which is adjacent to a resonant slot. Microwave energy is coupled to the slot, thereby exciting the slot. A second conductor is on the opposite side of the ground plane from the first conductor. Microwave energy from the excited resonant slot passes to the second conductor, thereby allowing contactless interconnection between the first conductor and the second conductor. The coupling may emphasize certain modes of propagation relative to other possible modes of propagation. Specifically, the ground plane and slot may be enclosed in a cavity of a size such that the cavity does not support any natural mode propagation inside the cavity. Instead, the coupling may have a cavity in which a transverse electromagnetic (TEM) mode is propagated.

20 Claims, 2 Drawing Sheets

ELECTROMAGNETIC COUPLING

This invention was made with government support under contract no. F08626-98-C-0027. The government has certain rights in this invention.

TECHNICAL FIELD

The invention relates to interconnections between electrical lines, and in particular to electromagnetic couplings, such as for use in transitions in radar seeker antennas.

DESCRIPTION OF THE RELATED ART

Coaxial line to suspended air stripline (or to convention stripline and/or microstripline) transitions are often used in radar seeker antennas. Conventional orthogonal transitions consist of brute force electrical contacts for both inner and outer conductors. Electrical connection for the inner conductor from coaxial line to suspended air stripline or conventional stripline is very difficult because of the small size of the inner conductor of a typical stripline circuit. Direct electrical connections involve, for example, soldering or otherwise connecting the coaxial conductors to the stripline conductors, or to mating electrical connectors. Such direct connections may be difficult to manufacture. Furthermore, due to the small sizes involved, such connections may involve high rates of failure. Another difficulty is that the small sizes of such connections may limit the power that they can handle.

SUMMARY OF THE INVENTION

An electrical connection from coaxial cable to suspended air stripline (SAS), to stripline, or to microstripline, utilizes an electromagnetic-coupled cavity-backed slot. This allows high power capability, lower profile, and a simpler and more secure interconnection, when compared to prior direct connection methods. One of the conductors is attached to a ground plane which is adjacent to a resonant slot. The ground plane and the slot are enclosed in a conductive cavity. Electrical signals through the conductor excites a response in the slot, which in turn, induces a signal in the other conductor, making for a contactless electrical connection between the two conductors. The connection may involve a rotary joint allowing one of the conductors, for example, the coaxial cable, to rotate relative to the other conductor.

According to an aspect of the invention, an electromagnetic coupling includes a first conductor; a conductive enclosure enclosing a cavity, wherein the first conductor is inserted into the cavity through a first opening in the enclosure; a ground plane within the cavity, the ground plane and the conductive enclosure defining a resonant slot therebetween, wherein the first conductor is electrically connected to the ground; and a second conductor inserted into the cavity through a second opening in the enclosure. The conductors are on respective opposite sides of the ground plane within the cavity. The first and second conductors are electromagnetically coupled with one another via the ground plane and the resonant slot.

According to another aspect of the invention, an electromagnetic coupling includes a first conductor; a second conductor that is substantially perpendicular to the first conductor; and means for contactlessly electromagnetically coupling the first conductor and the second conductor.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

An orthogonal electrical coupling relies on electromagnetic coupling for the inner connection, as opposed to direct contact between conductors. A conductor on one of the lines is connected to a ground plane which is adjacent to a resonant slot. Microwave energy is coupled to the slot, thereby exciting the slot. A second conductor is on the opposite side of the ground plane from the first conductor. Microwave energy from the excited resonant slot passes to the second conductor, thereby allowing contactless electrical interconnection between the first conductor and the second conductor. This coupling through the resonant slot may in general be any of a number of transmission modes. However, the coupling may emphasize certain modes of propagation relative to other possible modes of propagation. Specifically, the ground plane and slot may be enclosed in a cavity that is of a size such that the cavity does not support any natural mode propagation inside the cavity. Instead, the coupling may have a cavity in which a transverse electromagnetic (TEM) mode is propagated.

The coupling may involve connection of a coaxial cable to a suspended air stripline (SAS) conductor. The coupling may involve an orthogonal connection. In addition, the coupling may be a rotary coupling allowing one of the conductor cables to rotate relative to the other.

Figure 1:
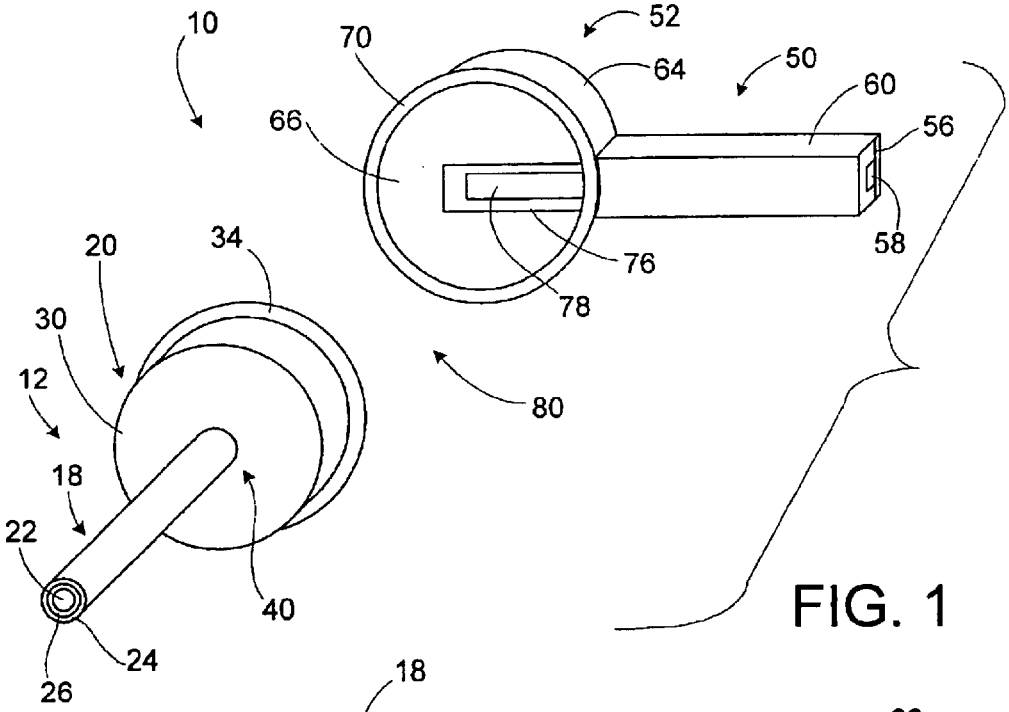
FIG. 1 is a perspective view of an electrical coupling in accordance with the present invention.

Turning now to FIG. 1, a coupling 10 is shown, which couples a coaxial connector 12 and a stripline cavity connector 14. As explained in greater detail below, the coupling 10 includes a contactless electrical connection between an inner conductor of a coaxial cable and the stripline conductor of a stripline cable.

The coaxial connector 12 includes a coaxial cable 18 and a coaxial connector termination 20. The coaxial cable 18, which may be of a conventional type, includes an inner conductor 22 and an outer conductor 24, with an insulator 26 therebetween.

Figure 2:
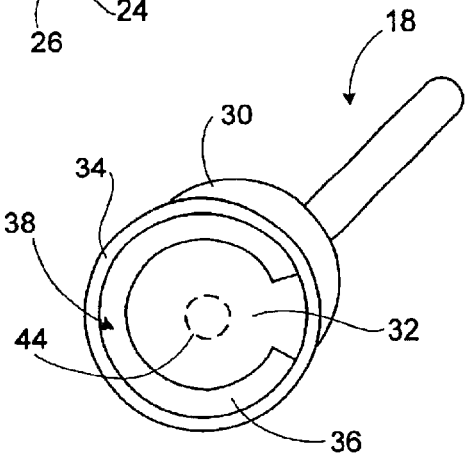
FIG. 2 is a perspective view of the coaxial connector terminator of the electrical coupling of FIG. 1, showing further details.

Referring now in additional to FIG. 2, the coaxial connector terminator 20 includes a coaxial connector enclosure 30, a ground plane 32, and a connection plate 34. The coaxial connector enclosure 30 is made of a conductive material, for example, a suitable metal. The ground plane 32 and the connection plate 34 are also made of a suitable metal, and are electrically coupled to and in contact with the coaxial connector enclosure 30. A resonant slot 36 is defined between the ground plane 32 and the connection plate 34. A coaxial connector cavity 38 is enclosed and defined by the coaxial connector enclosure 30 and the ground plane 32. The coaxial connector cavity 38 is in communication with the resonant slot 36.

The coaxial cable 18 is coupled to the coaxial connector terminator 20, with the outer conductor 24 of the coaxial cable connected to the coaxial connector enclosure 30. The inner conductor 22 of the coaxial cable 18 passes through the opening 40 and into the cavity defined by the coaxial connector enclosure 30. The inner conductor 22 is connected to the ground plane 32 at a connection point 44 (FIG. 2). The connection may be made by well-known methods, for example, by soldering.

The stripline cavity connector 14 includes a stripline cable 50 with a stripline terminator 52 attached to it. The stripline cable 50 includes a centrally-located insulator substrate 56 which supports a stripline conductor 58 mounted on it. An outer conductor 60 surrounds the insulator substrate 56 and stripline conductor 58.

The stripline terminator 52 includes a stripline connector enclosure 64, which defines a stripline connector cavity 66 therein. The stripline connector enclosure 64 is made of an electrically-conducting material, and is electrically coupled to the outer conductor 60 of the stripline cable 50. A stripline connection plate 70, also made of an electrically-conducting material, is attached to the stripline connector enclosure 64, around the periphery of the stripline connector enclosure. The stripline connection plate 70 is configured to mate or otherwise contact the connection plate 34 of the coaxial connector termination 20. Portions 76 and 78 of the insulator substrate 56 and the stripline connector 58, respectively, protrude into the stripline connector cavity 66.

The coupling 10 is configured to be assembled by mating or otherwise causing contact between the connection plate 34 and the stripline connection plate 70. The connection plates 34 and 70 may be attached to one another, for example, by use of an adhesive such as a conductive adhesive, or by utilization of suitable fasteners, for example, bolts, screws, rivets, or the like.

The stripline cable 50 may have a suitable insulator between the insulator substrate 56 and stripline connector 58, and the outer conductor 60. For example, there may be air filling the gaps between the outer connector 60 and the inside portions of the stripline cable 50.

When the connectors 12 and 14 of the coupling 10 are assembled together, their respective enclosures 30 and 64 combine together to form a single enclosure 80. This enclosure 80 encloses the portion of the inner conductor 22 which protrudes into the coaxial connector cavity 38, the ground plane 32, and the portions 76 and 78 of the stripline cable 50. As an electrical signal passes through the inner conductor 22 to the ground plane 32, and from there to the coaxial connector enclosure 30 and the outer conductor 24, the presence of the resonant slot 36 creates asymmetries in current flow through the ground plane 32. These asymmetries in current flow cause excitation of the resonant slot 36. These excitations induce a current in the stripline conductor portion 78.

Figure 3:
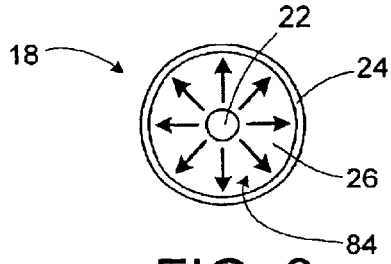
FIGS. 3 and 4 are cross-sectional views schematically illustrating preservation of a transverse electromagnetic (TEM) wave mode in, respectfully, a coaxial cable and a coaxial enclosure cavity, of a coaxial connector of the electrical coupling of FIG. 1.
Figure 4:
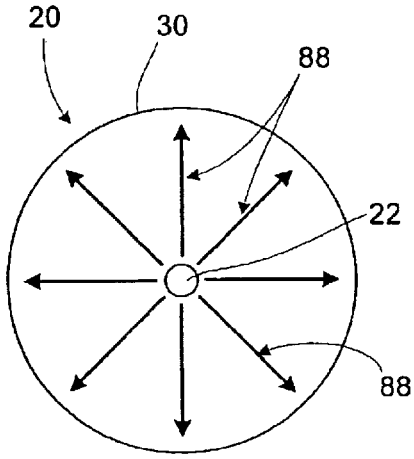

The enclosure 80 formed by the enclosure parts 30 and 64 eliminates undesirable coupling to other transmission modes. As illustrated in FIGS. 1 and 2, the coaxial connector cavity 38 may be cylindrical in shape. Such a shape preserves the coaxial transverse electromagnetic (TEM) wave mode, which is the mode of transmission along the coaxial cable 18. This preservation of the TEM wave mode is illustrated in FIGS. 3 and 4. FIG. 3 schematically shows a TEM wave mode 84 in the coaxial cable 18, between the outer conductor 24 and the inner conductor 22. FIG. 4 schematically shows a similar TEM wave mode 88 in the coaxial enclosure cavity 38, between the coaxial connector enclosure 30 and the portion of the inner conductor 22 that protrudes into the coaxial connector enclosure 30.

An exemplary cavity is a cylindrical cavity about 0.31 free space wavelengths in diameter and 0.1 free space wavelengths in height. However, it will be appreciated that other shapes and/or sizes may be utilized for the coaxial connector cavity 38. The resonant slot 36 may have a length of approximately 0.5 free space wavelength. As is illustrated, the resonant slot 36 may have a substantially annular shape, extending most of the way along the circular outer border (perimeter) of the ground plane 32. However, it will be appreciated that the resonant slot 36 may have other suitable sizes and/or shapes.

The coupling 10 produces an orthogonal connection. That is, the coaxial cable 18 enters the coaxial connector enclosure 30 in a direction substantially perpendicular to the direction that the stripline cable 50 enters the stripline connector enclosure 64. However, it will be appreciated that the coupling 10 may be modified to have other configurations of the coaxial cable and the stripline cable. Further, it will be appreciated that the modifications may be made to allow coupling of different types of conductors.

It will be appreciated that the coupling 10 advantageously has a contactless connection between the inner conductor 22 of the coaxial cable 18, and the stripline conductor 58 of the stripline cable 50. Thus, problems in soldering a relatively small inner conductor of a coaxial cable to the conductor of a stripline cable are avoided. Also therefore avoided are failures of such a connection, for example, due to heat-related deterioration of such a connection. A contactless connection such as in the coupling 10 is capable of advantageously handling higher power loads than corresponding connectors with direct contact. The diameter of the ground plane 32 may be about 0.3 inches, although it will be appreciated that other suitable dimensions may be employed.

The outer conductors 24 and 60 of the coaxial cable 18 and the stripline cable 50, respectively, may be attached to the respective coaxial connector termination 20 and the stripline termination 52 by conventional methods, such as soldering.

The coaxial connector termination 20 and the stripline termination 52 may be produced by convention-well known means, such as machining. The connection between the coaxial connector 12 and the stripline cavity connector 14 may also be made by conventional means, for example, by an adhesive connection utilizing a suitable epoxy, or by soldering or fastening together.

Figure 5:
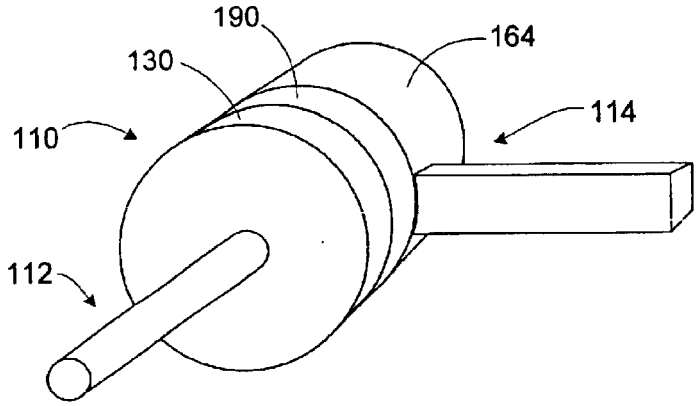
FIG. 5 is a perspective view of another electrical coupling, one which allows rotary motion between parts, in accordance with the present invention.

FIG. 5 shows an alternative embodiment coupling 110 that allows for rotary motion between a coaxial connector 112 and a stripline cavity connector 114. A suitable gimbal 190 may be used in the connection between a coaxial connector enclosure 130 and a stripline connector enclosure 164. The gimbal 190 allows electrical connection between the enclosures 130 and 164, while allowing relative motion between the connectors 112 and 114. For example, the gimbal allows rotation of the coaxial connector 112 about its axis while maintaining the stripline cavity connector 114 stationary.

Except as discussed above, details of the coaxial connector 112 may be similar to those of the coaxial connector 12 of the coupling 10, and details of the stripline cavity connector 114 may be similar to those of the stripline cavity connector 14 of the coupling 10.

One exemplary application for the couplings 10 and 110 above is in a missile radar processor.

Figure 6:
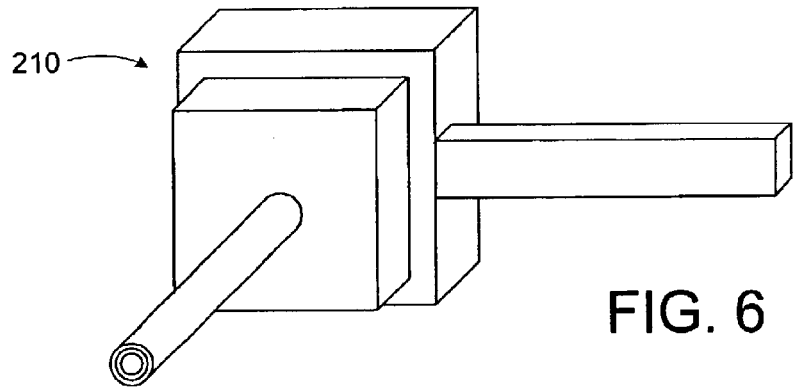
FIG. 6 is a perspective view of an electrical coupling with a rectangular cross-section, in accordance with the present invention.
Figure 7:
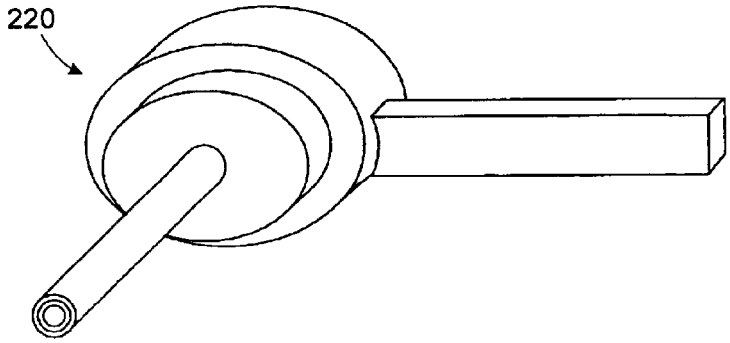
FIG. 7 is a perspective view of an electrical coupling with a elliptical cross-section, in accordance with the present invention.
Figure 8:
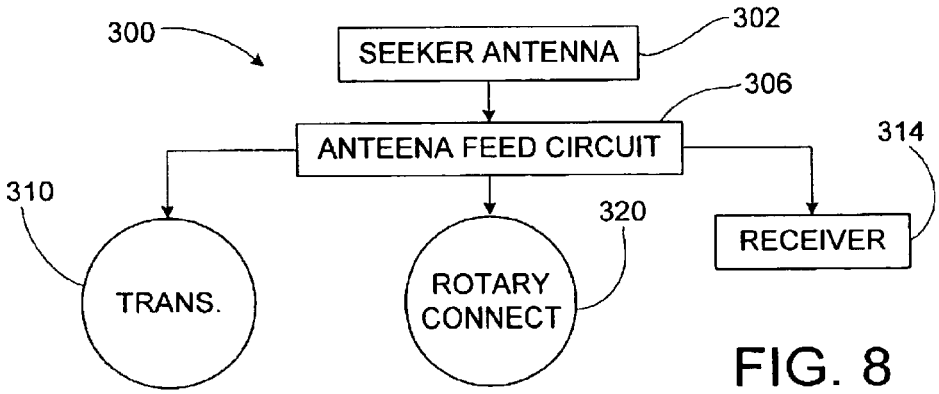
FIG. 8 is a schematic diagram illustrating use of electrical couplings in accordance with the present invention as part of a missile antennae system.

It will be appreciated that enclosures and cavities with other cross-sectional shapes may be employed. Examples of alternative cross-sectional shapes are illustrated in FIG. 6 and in FIG. 7. FIG. 6 shows a coupling 210 with parallelepiped-shaped cavities and enclosure, having a rectangular cross-section. FIG. 7 shows a coupling 220 with an elliptical cross-section. The resonant slots for the couplings 210 and 220 may be along the perimeter of the respective enclosures, as was the resonant slot 36 described above. It will be appreciated that other shapes for the cavities and the enclosure may be employed, such as various suitable polygonal shapes. Referring to FIG. 8, a missile antennae system 300 includes a seeker antennae 302, an antennae feed circuit 306, a transmitter 310, a receiver 314, and a rotary connection 320. Orthogonal transitions are possible at a number of points in the missile antennae system 300. In particular, such transitions are possible between the antennae feed circuit and the rotary connection, between the transmitter and the rotary connection, and/or between the receiver and the rotary connection.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electromagnetic coupling comprising:

a first conductor;

the conductive enclosure enclosing a cavity, wherein the first conductor is inserted into cavity through a first opening in the enclosure;

ground plane within the cavity, the ground plane and the conductive enclosure defining a resonant slot therebetween, wherein the first conductor is electrically connected to the ground; and a second conductor inserted into the cavity through a second opening in the enclosure;

wherein the conductors are on respective opposite sides of the ground plane within the cavity; and wherein the first and second conductors are electromagnetically coupled with one another via the ground plane and the resonant slot.

2. The electromagnetic coupling of claim 1, wherein the second conductor is substantially perpendicular to the first conductor.

3. The electromagnetic coupling of claim 1, wherein the first conductor is an inner conductor of a coaxial cable.

4. The electromagnetic coupling of claim 3, wherein an outer conductor of the coaxial cable is attached to at least a part of the conductive enclosure.

5. The electromagnetic coupling of claim 1, wherein the second conductor is attached to an insulator substrate which is enclosed by a ground conductor.

6. The electromagnetic coupling of claim 5, wherein the ground conductor is attached to at least a pad of the conductive enclosure.

7. The electromagnetic coupling of claim 1, wherein the second conductor is part of a stripline.

8. The electromagnetic coupling of claim 7, wherein the stripline is a suspended air stripline.

9. The electromagnetic coupling of claim 1, wherein the ground plane is electrically coupled to the conductive enclosure.

10. The electromagnetic coupling of claim 1, wherein the coupling includes a first connector coupled to a second connector; wherein the first connector includes the first conductor and a first part of the enclosure; and wherein the second connector includes the second conductor and a second part of the enclosure.

11. The electromagnetic coupling of claim 10, wherein one of the connectors includes a connection plate for linking the connectors together.

12. The electromagnetic coupling of claim 1, wherein the cavity is a substantially cylindrical cavity.

13. The electromagnetic coupling of claim 12, wherein the slot extends most of the way along an outer border of the cavity.

14. The electromagnetic coupling of claim 13, wherein the slot has a substantially annular shape.

15. The electromagnetic coupling of claim 12, wherein the cavity preserves a coaxial transverse electromagnetic (TEM) wave mode in the first conductor.

16. The electromagnetic coupling of claim 1, further comprising a rotational coupling operatively configured to allow the first conductor to rotate relative to the second conductor.

17. The electromagnetic coupling of claim 16, wherein the rotational coupling is a gimbal coupling a first part of the conductive enclosure to a second part of the conductive enclosure.

18. The electromagnetic coupling of claim 1, wherein the first conductor is soldered to the ground plane.

19. The electromagnetic coupling of claim 1 as part of a missile antennae system.

20. An electromagnetic coupling comprising:

a first conductor;

a conductive enclosure enclosing a cavity, wherein the first conductor is inserted into the cavity through a first opening in the enclosure;

a ground plane within the cavity, the ground plane and the conductive enclosure defining a resonant slot therebetween, wherein the first conductor is electrically connected to the ground;

a second conductor inserted into the cavity through a second opening in the enclosure;

a first connector that includes the first conductor and a first part of the enclosure; and a second connector that includes the second conductor and a second part of the enclosure;

wherein the conductors are on respective opposite sides of the ground plane within the cavity;

wherein the first and second conductors are electromagnetically coupled with one another via the ground plane and the resonant slot;

wherein the second conductor is substantially perpendicular to the first conductor.

* * * * *